US011638496B2

(12) United States Patent
Liao

(10) Patent No.: US 11,638,496 B2
(45) Date of Patent: May 2, 2023

(54) METHOD FOR MANUFACTURING FLEXIBLE PAPER STRAW AND FLEXIBLE PAPER STRAW

(71) Applicant: GRAND AI CO., LTD., Taipei (TW)

(72) Inventor: Chen-Yung Liao, Taipei (TW)

(73) Assignee: GRAND AI CO., LTD., Taipei (TW)

( * ) Notice: Subject to any disclaimer, the term of this patent is extended or adjusted under 35 U.S.C. 154(b) by 49 days.

(21) Appl. No.: 17/077,858

(22) Filed: Oct. 22, 2020

(65) Prior Publication Data

US 2021/0137293 A1 May 13, 2021

(30) Foreign Application Priority Data

Nov. 11, 2019 (TW) ..... 108140869

(51) Int. Cl.
*B31C 1/00* (2006.01)
*A47G 21/18* (2006.01)
*B31B 50/59* (2017.01)

(52) U.S. Cl.
CPC ..... *A47G 21/186* (2013.01); *B31B 50/592* (2018.05)

(58) Field of Classification Search
CPC ..... B31B 50/592; B31C 1/00; B31C 3/00; B31C 5/00; B31C 11/00; B31C 11/02; B31C 13/00; A47G 21/186; B31D 5/0047; B31D 5/0052; B31D 5/0095; B31D 5/02
USPC ..... 493/269
See application file for complete search history.

(56) References Cited

U.S. PATENT DOCUMENTS 1,996,066 A * 4/1935 Garling ..... B31C 3/00 138/144
2,094,268 A * 9/1937 Friedman ..... B29C 53/30 215/388
2,550,797 A * 5/1951 Friedman ..... B29C 53/30 239/33
3,025,004 A * 3/1962 Levi ..... B31F 1/205 239/33
3,270,778 A * 9/1966 Foll ..... B31C 3/00 138/144
4,613,474 A * 9/1986 Donati ..... B29C 59/021 198/803.12
5,697,786 A * 12/1997 Lange-Mickel ..... A61C 17/08 433/96
5,938,587 A * 8/1999 Taylor ..... B29C 53/30 239/33
2008/0009399 A1* 1/2008 Gelli ..... B29C 53/30 215/388

* cited by examiner

*Primary Examiner* — Sameh Tawfik
(74) *Attorney, Agent, or Firm* — Chun-Ming Shih; Lanway IPR Services

(57) ABSTRACT

A method for manufacturing flexible paper straws and flexible paper straws are revealed. The method includes the steps of preparing a paper tube which is a spiral tube by glue and paper, inserting a support shaft into the paper tube axially, placing the paper tube with the support shaft between a first roller and a second roller before curing of the glue while the first and second rollers are in parallel and having a plurality of circular grooves on a cylindrical surface thereof, rolling the paper tube by the first and second rollers to form a corrugated portion on a part of the paper tube, squeezing the corrugated portion to compress the corrugated portion for a period of time for curing the glue and holding shape of the corrugated portion, and removing the support shaft to get a flexible paper straw which is bendable at the corrugated portion.

8 Claims, 10 Drawing Sheets

METHOD FOR MANUFACTURING FLEXIBLE PAPER STRAW AND FLEXIBLE PAPER STRAW

BACKGROUND OF THE INVENTION

Technical Field

The present invention relates to paper straws, especially to a method for manufacturing flexible paper straws and flexible paper straws obtained.

Description of Related Art

Nowadays most of the straws are made of plastic. The number of the straws consumer globally every day is extremely large. The large amount of plastic waste generated not only has a detrimental impact on the environment, the processing cost of the plastic waste is also increased dramatically.

In order to solve the problems caused by the plastic straws mentioned above, reusable stainless straws are available on the market now. Although the stainless straw has the advantages of reusable and portable, the number of user is still limited and the penetrate rate is quite low. Thus the stainless straw is unable to replace the plastic straw completely and the environmental problems caused by the plastic straw are unable to be solved in near future.

Moreover, some paper straws available can be burned or degraded naturally and this helps to solve the environmental issues. Yet the paper straw is not bendy or unable to be bent to the desired degree such as 180 degrees easily. Thus the paper straw can't meet requirements for certain products as well as the consumers' needs and habits.

Refer to Chinese Pat. No. CN204363651U, a paper straw is disclosed. A plurality of circular patterns are formed on one end of the straw by indenting and an interval between the two adjacent circular patterns is ranging from 5 mm to 12 mm. Thus one end of the straw can be curved at an angle. However, the circular patterns are only provided on the outer surface of the paper straw. The inner wall of the paper straw is still a flat surface. Moreover, the interval between the circular patterns is large and the circular patterns are not centered at certain area so that it is hard to keep the paper straw at the curved state after being bent. Thus there is room for improvement and there is a need to provide a novel paper straw with an improved bend whose shape is easy to keep.

SUMMARY OF THE INVENTION

Therefore it is a primary object of the present invention to provide a method for manufacturing flexible paper straws and flexible paper straws obtained which solve the problems mentioned above.

In order to achieve the above object, a method for manufacturing flexible paper straws according to the present invention includes the following steps:

preparing a paper tube which is a spiral tube having a tube wall with at least two layers and formed by using glue and paper material while the glue is located between the two adjacent and overlapped layers of the tube wall;

inserting a support shaft into the paper tube axially;

placing the paper tube with the support shaft between a first roller and a second roller in an axially parallel manner before complete curing of the glue while an axis of the first roller and an axis of the second roller are in parallel; a cylindrical surface of the first roller is provided with a plurality of spaced parallel first circular grooves and a cylindrical surface of the second roller is also provided with a plurality of spaced parallel second circular grooves while positions and shapes of sections of the first circular grooves of the first roller and the second circular grooves of the second roller are aligned and matched to each other;

rolling the paper tube by using the first roller working together with the second roller so that a corrugated portion is formed on the tube wall of a part of the paper tube with a certain length;

applying a pushing force axially to each of two ends of the paper tube with the corrugated portion for compression of the corrugated portion; and removing the support shaft and curing the glue by baking or heating.

Preferably, the paper tube is a spiral tube having a tube wall with two layers and prepared by two-layer paper sheet material and the glue.

Preferably, the paper tube is a spiral tube having a tube wall with three layers and prepared by three-layer paper sheet material and the glue.

Preferably, the support shaft is a long cylindrical shaft with constant diameter and a smooth outer surface. An outer diameter of the support shaft is smaller than an inner diameter of the paper tube so as to have a gap between the outer surface of the support shaft and an inner surface of the tube wall of the paper tube for formation of the corrugated portion.

Preferably, a plurality of third circular grooves are axially formed on a part of the support shaft with a certain length. The shape of a section of the third circular groove and the shape of sections of the first and the second circular grooves match up. The corrugated portion is formed on the tube wall of the paper tube by the first circular grooves, the second circular grooves, and the third circular grooves working together with one another.

Preferably, the shape of respective longitudinal sections of the first circular groove, the second circular groove, and the third circular groove is serrated or triangular.

Preferably, the inner surface of the tube wall of the paper tube is coated with a waterproof coating made from biodegradable materials.

Preferably, the waterproof coating is a polylactic acid (PLA) coating.

The flexible paper straws according to the present invention can solve not only environmental problems caused by conventional plastic straws but also the technical problem of the paper straw such as unbending nature and difficulty in keeping the bend.

In order to learn technical features of the present invention, detailed description and preferred embodiment of the invention will be set forth in the following content with reference to the related figures. The following descriptions and related figures are only showing some preferred embodiments of the present invention. People skilled in the art can easily perform modifications and enhancements to the embodiments.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

The following descriptions related to portions, including upper, lower, left, right, etc. are generally based on directions of the components shown in figures without specifically describing them.

Figure 1A:
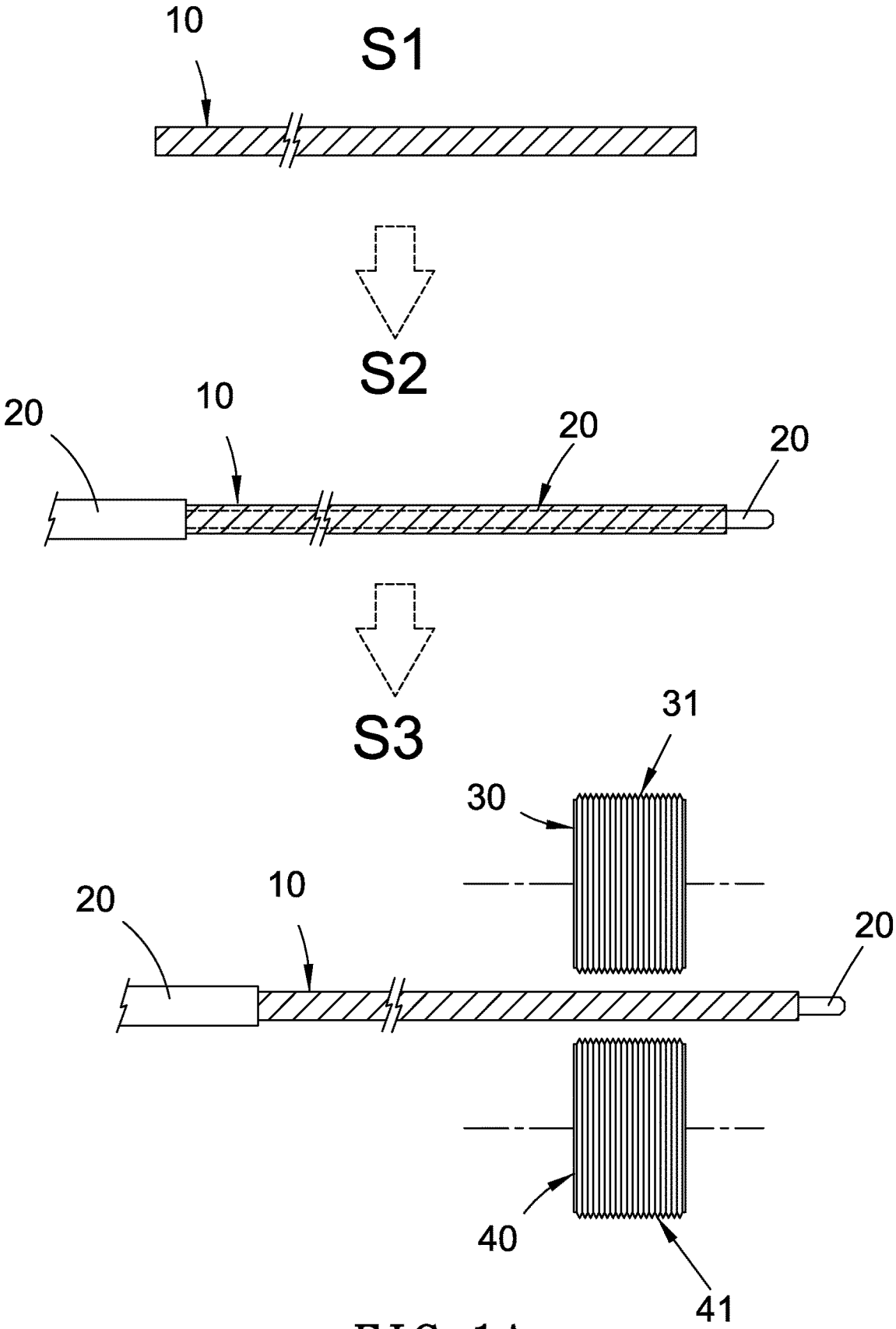
FIG. 1A-1B are schematic drawings showing a workflow of an embodiment according to the present invention.
Figure 1B:
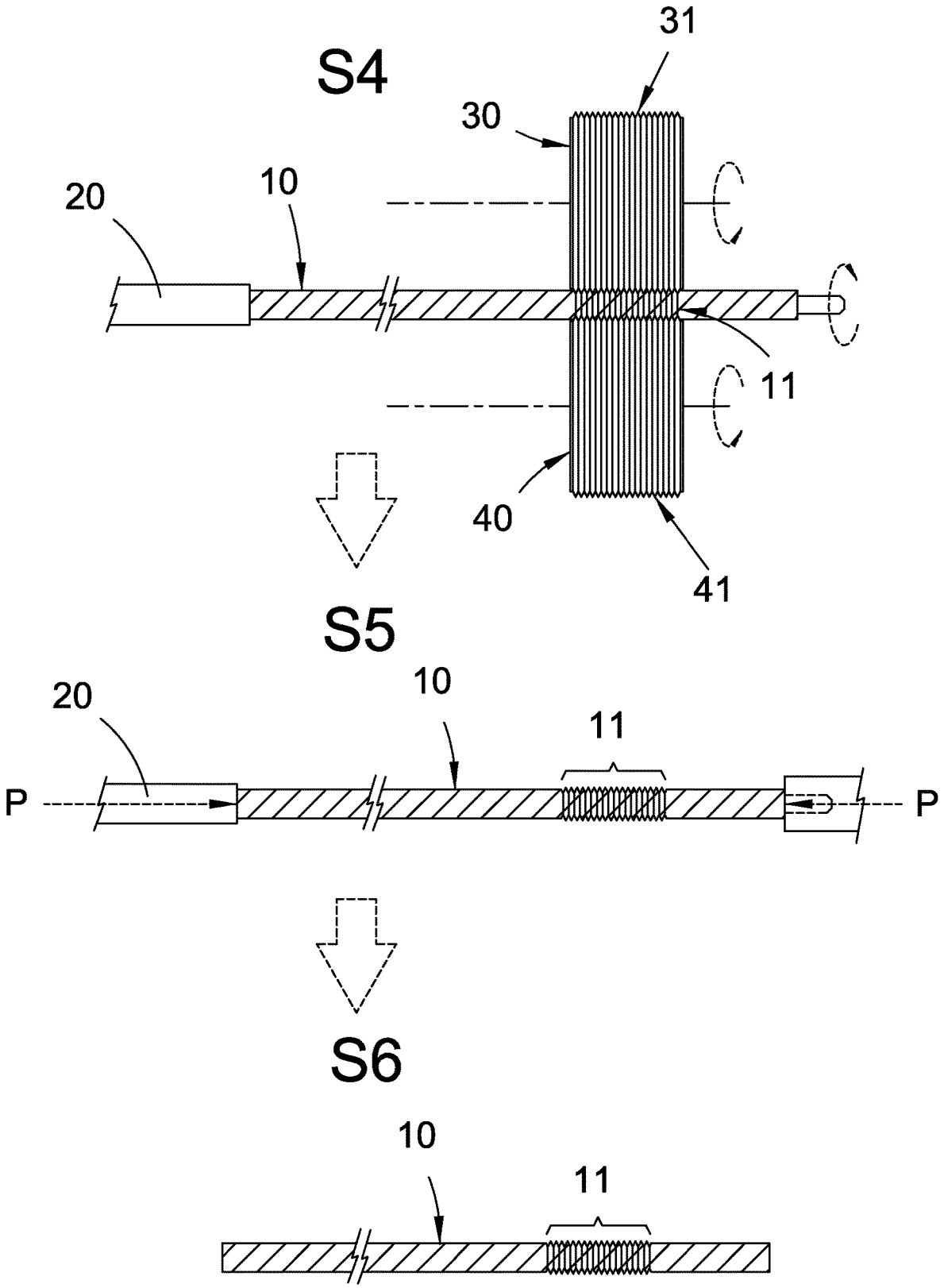

Refer to FIG. 1A and FIG. 1B, a flow chart showing steps of an embodiment of a method for manufacturing flexible paper straws and flexible paper straws obtained according to the present invention is revealed.

The method for manufacturing flexible paper straws according to the present invention includes the following steps:

S1 preparing a paper tube 10 which is a spiral tube having a tube wall with at least two layers and formed by using glue and paper material while the glue is located between the two adjacent and overlapped layers of the tube wall;

S2 inserting a support shaft 20 into the paper tube 10 axially;

S3 placing the paper tube 10 with the support shaft 20 between a first roller 30 and a second roller 40 in an axially parallel manner before complete curing of the glue while an axis of the first roller 30 and an axis of the second roller 40 are in parallel. In other words, an axis of the paper tube 10 and an axis of the support shaft 20 are in parallel with the axes of the first roller 30 and the second roller 40. A plurality of spaced parallel first circular grooves 31 are formed on a cylindrical surface of the first roller 30 while a cylindrical surface of the second roller 40 is provided with a plurality of spaced parallel second circular grooves 41. The positions and the shapes of the sections of the first circular grooves 31 of the first roller 30 and the second circular grooves 41 of the second roller 40 are aligned and matched to each other.

S4 rolling the paper tube 10 by using the first roller 30 working together with the second roller 40 so that a corrugated portion 11 is formed on the tube wall of a part of the paper tube 10 with a certain length;

S5 applying a pushing force P axially to each of two ends of the paper tube 10 with the corrugated portion 11 for pressing and squeezing the corrugated portion 11; and S6: pulling the support shaft 20 out and curing the glue by baking or heating. The paper tube 10 with the corrugated portion 11 obtained is a flexible paper straw which is bendable freely at the corrugated portion 11.

The paper tube 10 used in the step S1 is a tube having a tube wall with at least two layers and basically formed by paper sheet material (generally paper strips) being wound spirally and adhered to each other by the glue. In a preferred embodiment, an inner wall surface of the paper tube 10 is coated with a waterproof coating 60 which is made from biodegradable materials such as polylactic acid (PLA). The waterproof coating 60 can improve water resistance of the paper straw while the material therefor is not only environmental friendly but also able to meet environmental requirements.

Figure 2:
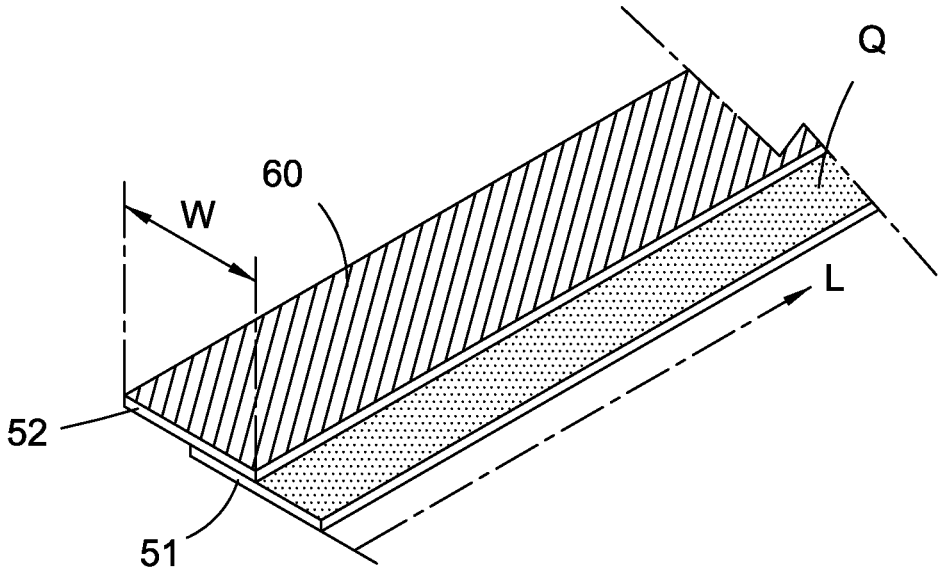
FIG. 2 is a schematic drawing showing structure of a two-layer paper sheet material of an embodiment according to the present invention.
Figure 3:
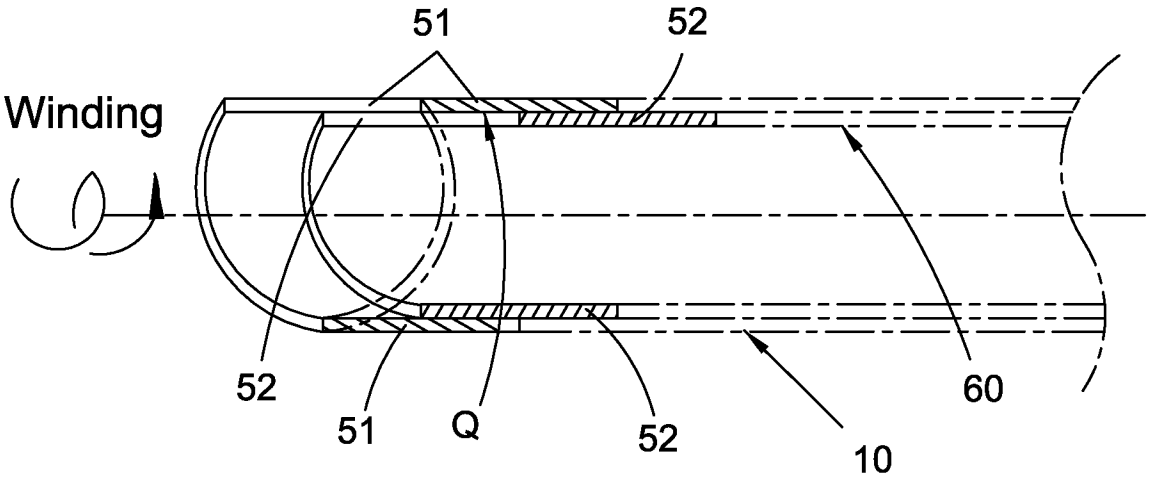
FIG. 3 is a schematic drawing showing a paper tube having spiral tube structure and made of the two-layer paper sheet material in FIG. 2 of an embodiment according to the present invention.

Refer to FIG. 2 and FIG. 3, an embodiment of a paper straw is revealed. In this embodiment, the paper tube 10 is made from two-layer paper sheet material which includes a first layer of paper 51 and a second layer of paper 52. The first layer of paper 51 and the second layer of paper 52 are paper strips with the same width. The long side L of the first layer of paper 51 and the long side of the second layer of paper 52 are stacked and overlapping like tiles (as shown in FIG. 2) while one half of the first layer of paper 51 is adhered to one half of the second layer of paper 52 in the lengthwise direction by glue Q. The width of the half of the first or second layer of paper is a half of the length of the short side thereof (½ W). The two-layer paper sheet material is spirally wound and adhered by the glue Q in a staggered and overlapping manner to form the paper tube 10 with the two-layer tube wall. The first layer of paper 51 forms the outermost layer of the paper tube 10 and the second layer of paper 52 becomes the inner layer of the paper tube 10 (as shown in FIG. 3) while the glue Q is located between two layers of the tube wall which are formed by the first layer of paper 51 and the second layer of paper 52 respectively.

Figure 4:
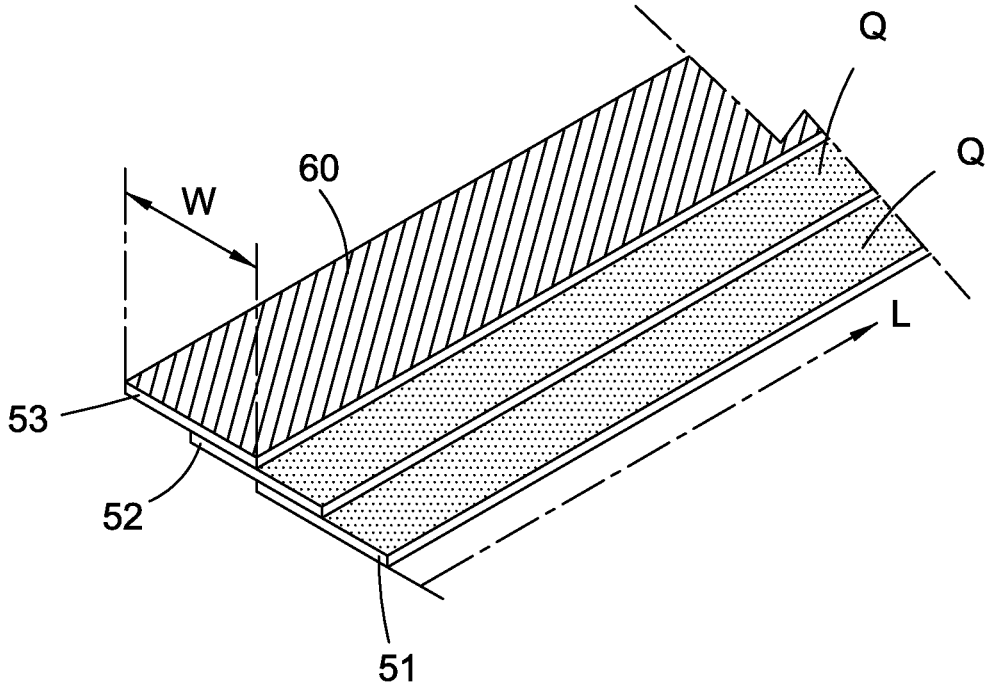
FIG. 4 is a schematic drawing showing structure of a three-layer paper sheet material of an embodiment according to the present invention.
Figure 5:
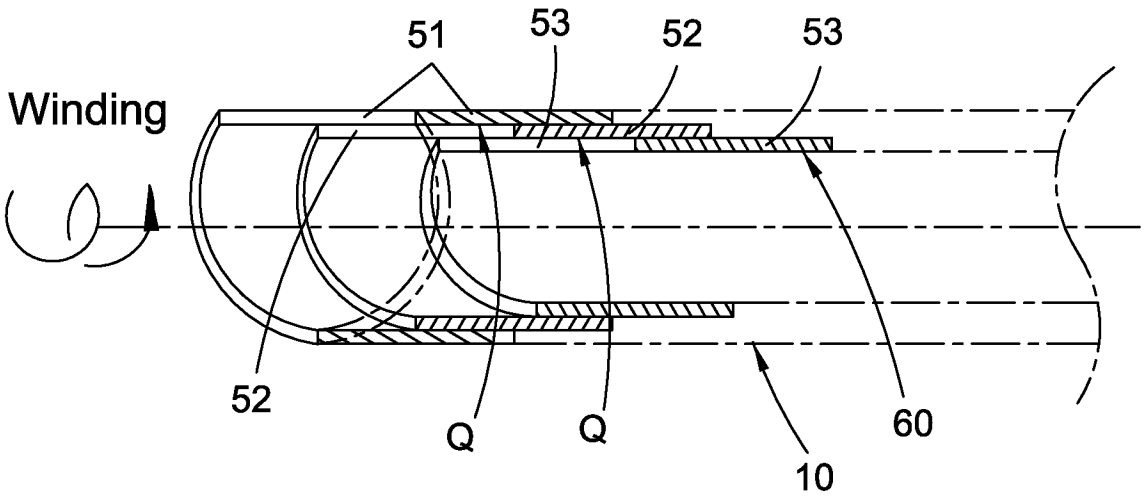
FIG. 5 is a schematic drawing showing a paper tube having spiral tube structure and made of the three-layer paper sheet material in FIG. 4 of an embodiment according to the present invention.

Refer to FIG. 4 and FIG. 5, another embodiment of a paper straw is revealed. In this embodiment, the paper tube 10 is made from three-layer paper sheet material which includes a first layer of paper 51, a second layer of paper 52 and a third layer of paper 53. The first layer of paper 51, the second layer of paper 52 and the third layer of paper 53 are all paper strips with the same width and wound spirally in the same manner mentioned above. The respective long sides L of the first layer of paper 51, the second layer of paper 52 and the third layer of paper 53 are stacked and overlapping like tiles (as shown in FIG. 4) while one half of the first layer of paper 51 is adhered to one half of the second layer of paper 52 and the other half of the second layer of paper 52 is adhered to one half of the third layer of paper 53. in the lengthwise direction by glue Q. The width of the half of the first, the second, or the third layer of paper 51, 52, or 53 is a half of the length of the short side thereof (½ W). The three-layer paper sheet material is spirally wound and adhered by the glue Q in the same staggered and overlapping manner mentioned above to form the paper tube 10 with the three-layer tube wall. The first layer of paper 51 forms the outermost layer of the paper tube 10, the second layer of paper 52 becomes the intermediate layer of the paper tube 10 and the third layer of paper 53 forms the innermost layer of the paper tube 10 (as shown in FIG. 5) while the glue Q is located between the two adjacent layers of the tube walls, not only between the first layer of paper 51 and the second layer of paper 52 but also between the second layer of paper 52 and the third layer of paper 53.

Figure 7:
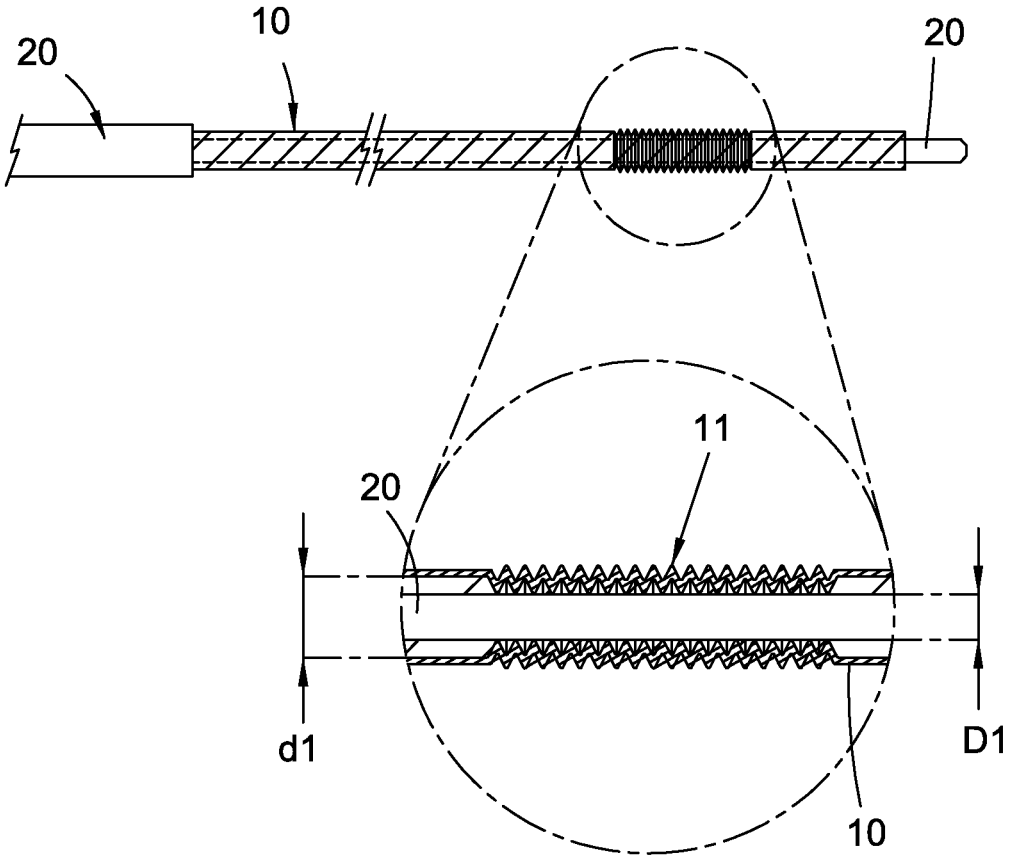
FIG. 7 is a sectional view of a paper tube and a support shaft of an embodiment according to the present invention.

In the step S2, the cross section (transverse section) of the support shaft 20 is circular and having the same radius over the entire length of the support shaft 20. Put simply, the support shaft 20 is a long cylindrical shaft with constant diameter and a smooth outer surface. In a preferred embodiment, an outer diameter D of the support shaft 20 is a bit smaller than an inner diameter dl of the paper tube 10 (as shown in FIG. 7) so as to have a gap between the outer surface of the support shaft 20 and an inner surface of the tube wall of the paper tube 10 for formation of the corrugated portion 11. The corrugated portion 11 is a circular tube having parallel ridges and grooves on the longitudinal (radial) section thereof (also called bellow).

Figure 8:
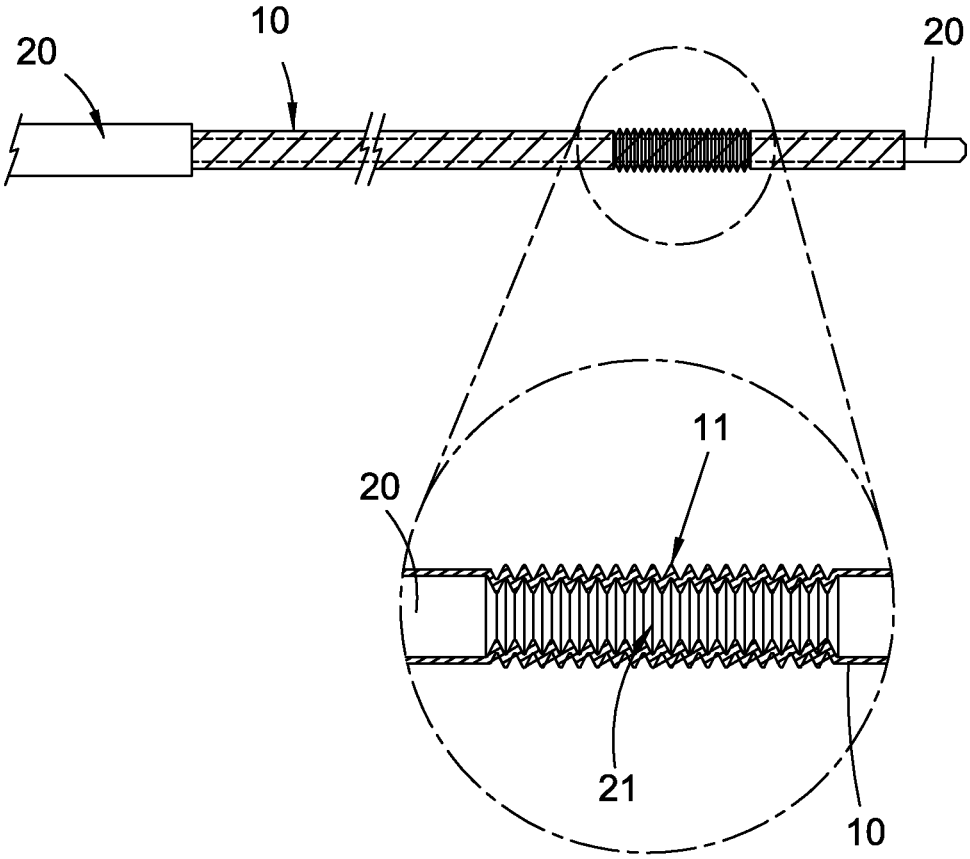
FIG. 8 is a sectional view of a paper tube and a support shaft of another embodiment according to the present invention.
Figure 9:
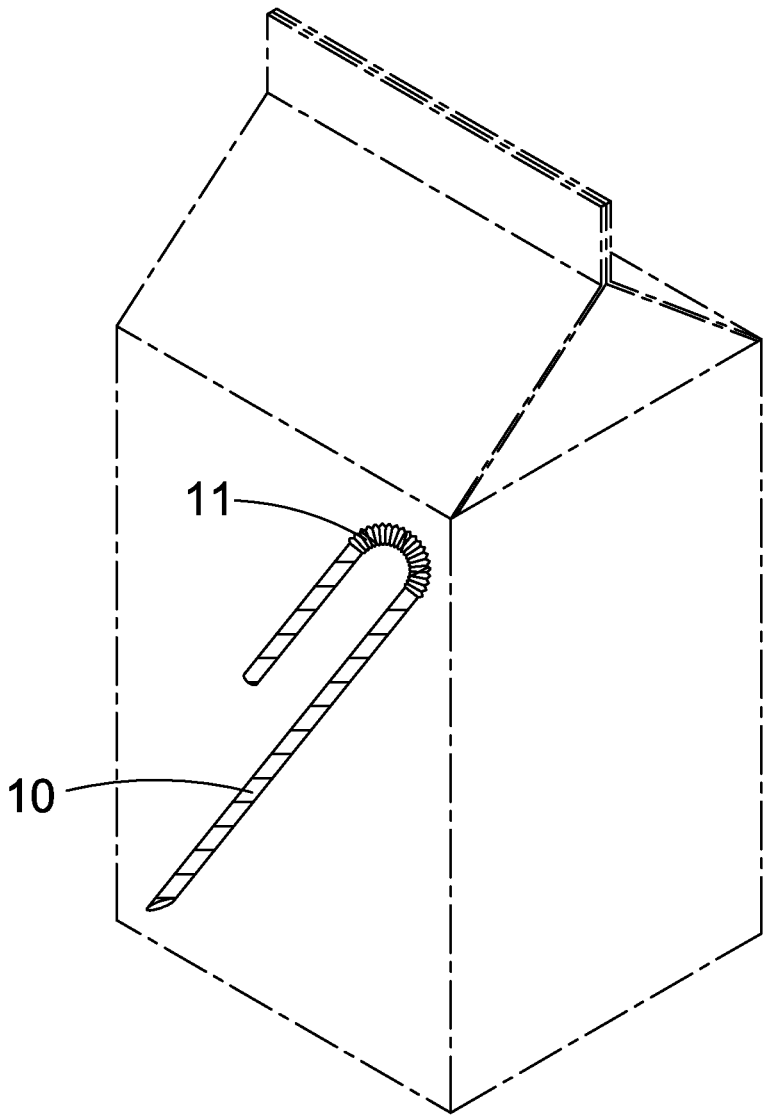
FIG. 9 is a schematic drawing showing an embodiment of a flexible paper straw in use according to the present invention.

In a preferred embodiment, a plurality of third circular grooves 21 are axially formed on a part of the support shaft 20 with a certain length (as shown in FIG. 8). The shape of the section of the third circular groove 21 and the shapes of the sections of the first and the second circular grooves 31, 41 match up. By the first circular grooves 31, the second circular grooves 41, and the third circular grooves 21 working together with one another, a corrugated portion 11 is formed on the tube wall of the paper tube 10. The shape of the respective longitudinal sections (radial sections) of the first circular groove 31, the second circular groove 41, and the third circular groove 21 is serrated or triangular.

Figure 6:
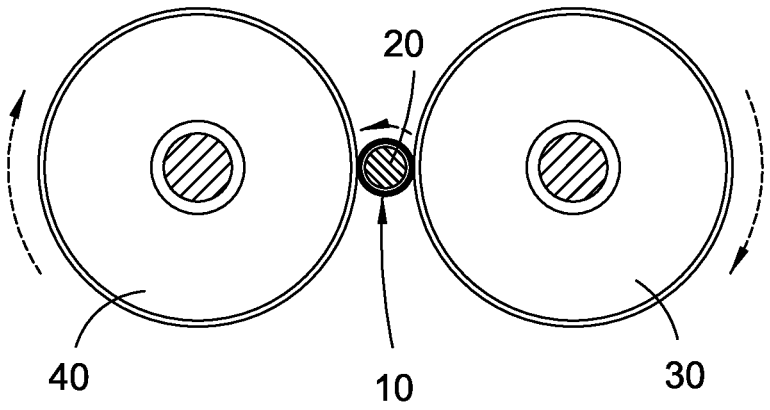
FIG. 6 is a schematic drawing showing a paper tube being rolled by a first roller working together with a second roller of an embodiment according to the present invention.

In the steps S3 and S4, the paper tube 10 with the support shaft 20 is placed between the first roller 30 and the second roller 40 before complete curing of the glue Q. Then the paper tube 10 is rolled by the first roller 30 working together with the second roller 40 to form the corrugated portion 11 on the tube wall of a part of the paper tube 10 with a certain length. The glue Q is not cured yet so that the paper tube 10 still has good formability and this helps the formation of the corrugated portion 11. During the rolling process, the first roller 30 and the second roller 40 apply pressure toward the axis of the e paper tube 10 and rotate in the same direction (able to be synchronous) (as shown in FIG. 6). Thereby the corrugated portion 11 is formed on the tube wall of the paper tube 10 between the cylindrical surfaces of the first roller 30 and the second roller 40.

Refer to the step S5, a pushing force P is axially applied to two ends of the paper tube 10 provided with the corrugated portion 11. Now the first roller 30 and the second roller 40 are moved away from the corrugated portion 11 of the paper tube 10 to two ends of the paper tube 10 for pressing or squeezing the two ends of the corrugated portion 11 axially. Thus the corrugated portion 11 is compressed and maintained in the compressed state for a period of time for further curing of the glue Q.

In a preferred embodiment of the present invention, a pushing force is applied axially to each of the two ends of the paper tube 10 before complete curing of the glue Q for compressing the corrugated portion 11. During the pressing or squeezing process, adhesive properties of a part of the glue Q at the corrugated portion 11 can be damaged by external force because the glue Q is not cured completely. Thus the corrugated portion 11 of the paper tube 10 can be easily bent at 180 degrees and a space for deformation is provided. Then the glue Q is cured quickly by baking or heating (the process usually takes only a few seconds). The cured glue Q can hold the shape and stabilize the structure of the corrugated portion 11 to prevent the corrugated portion 11 from turning back to a straight tube with flat surface.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A method for manufacturing a flexible paper straw, comprising steps of:

preparing a paper tube which is a spiral tube having a tube wall with at least two layers and formed by using glue and paper material while the glue is located between the two adjacent and overlapped layers of the tube wall;

inserting a support shaft into the paper tube axially;

placing the paper tube with the support shaft between a first roller and a second roller in an axially parallel manner before the glue being cured completely while an axis of the first roller and an axis of the second roller are in parallel, wherein a cylindrical surface of the first roller is provided with a plurality of spaced parallel first circular grooves and a cylindrical surface of the second roller is also provided with a plurality of spaced parallel second circular grooves while positions and shapes of sections of the first circular grooves of the first roller and the second circular grooves of the second roller are aligned and matched to each other;

rolling the paper tube by using the first roller working together with the second roller so that a corrugated portion is formed on the tube wall of a part of the paper tube with a certain length;

applying a pushing force axially to each of two ends of the paper tube with the corrugated portion before complete curing of the glue for compression of the corrugated portion, wherein adhesive properties of a part of the glue at the corrugated portion are damaged by external force because the glue is not cured completely, thus the corrugated portion of the paper tube is easily bent at 180 degrees and a space for deformation is provided; and removing the support shaft and curing the glue by baking or heating in few seconds to obtain the flexible paper straw, so a cured glue holds a shape and stabilizes a structure of the corrugated portion to prevent the corrugated portion from turning back to a straight tube with flat surface.

2. The method as claimed in claim 1, wherein the paper tube is the spiral tube having the tube wall with two layers and prepared by two-layer paper sheet material and the glue, wherein the two-layer paper sheet material includes a first layer of paper and a second layer of paper; the first layer of paper and the second layer of paper are paper strips with same width; a long side of the first layer of paper and a long side of the second layer of paper are stacked and overlapping like tiles while one half of the first layer of paper is adhered to one half of the second layer of paper in a lengthwise direction by the glue; a width of the half of the first or the second layer of paper is half of the length of a short side thereof; the two-layer paper sheet material is spirally wound and adhered by the glue in a staggered and overlapping manner to form the paper tube; the first layer of paper forms an outermost layer of the paper tube and the second layer of paper becomes an inner layer of the paper tube while the glue is located between two layers of the tube wall which are formed by the first layer of paper and the second layer of paper respectively.

3. The method as claimed in claim 1, wherein the paper tube is the spiral tube having the tube wall with three layers and prepared by three-layer paper sheet material and the glue.

4. The method as claimed in claim 1, wherein the support shaft is a long cylindrical shaft with constant diameter and a smooth outer surface; an outer diameter of the support shaft is smaller than an inner diameter of the paper tube so as to have a gap between the outer surface of the support shaft and an inner surface of the tube wall of the paper tube for formation of the corrugated portion.

5. The method as claimed in claim 1, wherein a plurality of third circular grooves are axially formed on a part of the support shaft with a certain length; shape of a section of the third circular groove and shape of sections of the first and the second circular grooves match up; the corrugated portion is formed on the tube wall of the paper tube by the first circular grooves, the second circular grooves, and the third circular grooves working together with one another.

6. The method as claimed in claim 5, wherein shape of respective longitudinal sections of the first circular groove, the second circular groove, and the third circular groove is serrated or triangular.

7. The method as claimed in claim 1, wherein an inner surface of the tube wall of the paper tube is coated with a waterproof coating made from biodegradable materials.

8. The method as claimed in claim 7, wherein the waterproof coating is a polylactic acid (PLA) coating.

* * * * *